US007921995B2

(12) United States Patent
Kuo

(10) Patent No.: US 7,921,995 B2
(45) Date of Patent: Apr. 12, 2011

(54) GOLF BAG STRUCTURE

(75) Inventor: Wei-Te Kuo, Taipei (TW)

(73) Assignee: Riidea Inc., Taipei County (TW)

( * ) Notice: Subject to any disclaimer, the term of this patent is extended or adjusted under 35 U.S.C. 154(b) by 691 days.

(21) Appl. No.: 11/957,507

(22) Filed: Dec. 17, 2007

(65) Prior Publication Data

US 2009/0152145 A1 Jun. 18, 2009

(51) Int. Cl.
*A63B 55/04* (2006.01)

(52) U.S. Cl. ..... 206/315.7; 280/30; 280/DIG. 6; 280/47.26; 280/655

(58) Field of Classification Search ..... 206/315.7; 280/30, 47.26, DIG. 6, 652
See application file for complete search history.

(56) References Cited

U.S. PATENT DOCUMENTS

| | | | | |
|---|---|---|---|---|
| 2,422,298 | A * | 6/1947 | Freis | 280/42 |
| 3,726,537 | A * | 4/1973 | McLoughlin | 280/47.26 |
| 3,831,958 | A * | 8/1974 | Keaton | 280/646 |
| 3,985,373 | A * | 10/1976 | Widegren | 280/652 |
| 4,792,152 | A * | 12/1988 | Carolan | 280/47.26 |
| 5,632,496 | A * | 5/1997 | Nelson | 280/30 |
| 5,879,022 | A * | 3/1999 | Winton | 280/655 |
| 6,186,520 | B1 * | 2/2001 | Barten | 280/30 |
| 6,425,589 | B1 * | 7/2002 | Wu | 280/30 |
| 6,997,274 | B2 * | 2/2006 | Metten | 180/19.1 |

* cited by examiner

*Primary Examiner* — Tri M Mai

(57) ABSTRACT

The present invention discloses a golf bag structure. The main body of the structure includes a bag portion, a pulling portion and a receiving portion, wherein the pulling portion is provided on the side of the bag portion and the pulling portion includes a handle, a pulling lever and at least one wheel. The handle is assembled with the pulling lever. The wheel is provided at one end of the pulling lever and can be detached therefrom. Additionally, the receiving portion is provided at one end of the bag portion and can receive the detached wheel, thereby reducing the size of the main body.

3 Claims, 6 Drawing Sheets

GOLF BAG STRUCTURE

FIELD OF THE INVENTION

The present invention relates to a golf bag structure; particularly, it relates to a structural design of a golf bag capable of receiving a wheel detached therefrom for saving space.

BACKGROUND OF THE INVENTION

As the quality of life improves, people start to pay attention to the leisure life besides work. In addition to going shopping in the malls or busy streets, people start to learn a variety of sports to ease their minds and bodies. While sports, such as basketball, table tennis, running and swimming, etc., can develop one's physical strength, competitions thereof can additionally increase the fun such that people can forget the physical fatigue brought by the sports.

However, most sports are played in a limited area. Usually, the sports are played in an arena on campus or in the parks, and thus people cannot be away from the polluted air and noise in the city and can be very irritated. Additionally, sports are usually played in teams so that physical collision happens quite often and thus can cause sports injury very easily. Therefore, sports like golf that is played in an open environment and relatively moderate have become popular.

The biggest advantage of golf is that it is played outside. As a golf playing field is quite large, the sport is more moderate and relaxing to play. Thus, it is a very popular sport. People playing golf are closer to the nature and in more moderate pace so as to feel more relaxed. However, the terrain on the golf course may be up and down, and thus a variety of clubs are utilized to obtain the best hitting result. The increased number of clubs brings difficulties on the carrying and management of the clubs. Therefore, some suppliers develop golf club carrying devices for containing the golf clubs.

A conventional golf club carrying device can be referred to the one disclosed in Taiwan Patent NO. 81208500, titled "Detachable golf bag cart," which discloses a golf bag cart that is detachable and provided with a clamping base on the top and bottom of the golf bag, respectively, so that the golf bag cart can be mounted on the clamping base. Thereupon, the golf bag cart can not only be pushed and pulled, but can also be carried on a golf player's back so as to provide practical use to the player.

However, although the conventional golf club carrying device can contain and carry golf clubs, the golf bag and golf bag cart are not assembled in an ideal manner. The retracting function of the cart is very limited, and thus the overall size still takes up a lot of space. The wheel and branch lever protruded from the cart structure are especially the portions that can easily collide with other objects when the main body is carried and placed. Without an appropriate retracting design, it is hard to carry around and can be easily deformed when colliding with other objects. Therefore, it is needed to develop a golf club carrying device capable of receiving wheels and branch lever.

SUMMARY OF THE INVENTION

One object of the present invention is to provide a golf bag structure, which improves the retracting capacity of the conventional golf club carrying device.

Therefore, the present invention is a practical and non-obvious invention worth disclosing to the industry for public use.

To achieve above object, the present invention provides a golf bag structure, comprising a main body with a bag portion, a pulling portion and a receiving portion, wherein the pulling portion is provided at a side of the bag portion; the pulling portion includes a handle, at least one pulling lever and a wheel; the handle is assembled with the pulling lever; and the wheel is detachably provided at one end of the pulling lever; and the receiving portion is provided at one end of the bag portion and for receiving the wheel detached from the pulling lever so as to save space for the main body. Said receiving portion has at least one engaging element for assisting in affixing the wheel to the receiving portion. One side of the wheel has a rolling set such that when the wheel is received in the receiving portion, the rolling set can roll the main body. One side of the wheel has a rolling set such that when the wheel is received in the receiving portion, the rolling set can roll the main body. One side of the wheel has at least one containing portion so as to contain the pulling lever. the pulling lever is detachable from the handle and the pulling lever is in a joint shape and is retractable. the pulling lever can be detached from the handle and the pulling lever is in a joint shape and is retractable. The handle and the pulling lever are pivotally connected so as that the handle and the pulling lever can be drawn close for receiving purpose.

DETAILED DESCRIPTION OF THE EMBODIMENTS

Figure 1:
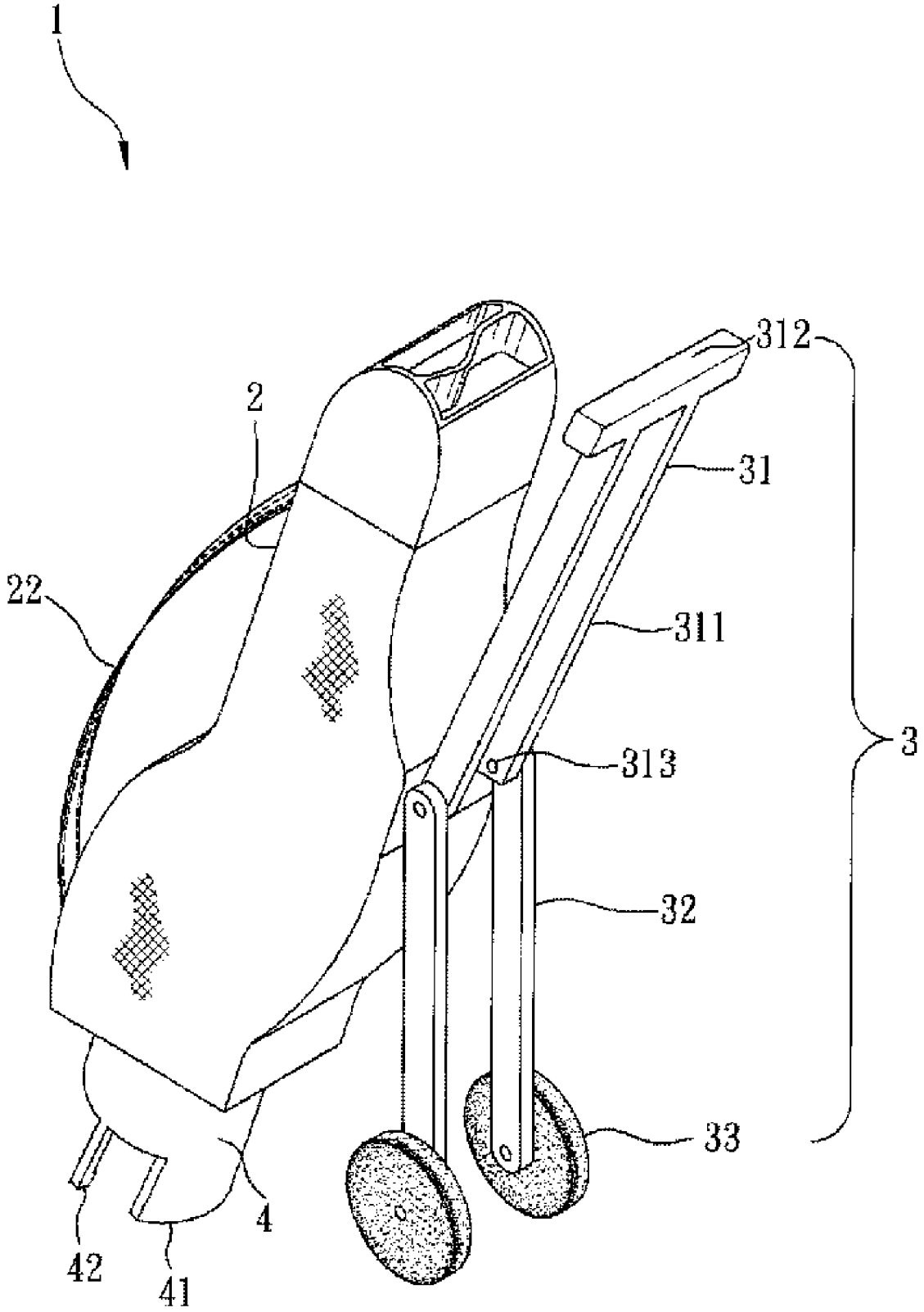
FIG. 1 is a perspective schematic view of a golf bag structure in accordance with the present invention.

The present invention relates to a golf bag structure. Refer to FIG. 1. The main body 1 mainly includes a bag portion 2, a pulling portion 3 and a receiving portion 4, wherein:

The bag portion 2 is approximately in a rectangular shape. The side of the bag portion 2 is provided with a strap 22. Two sides of the strap 22 are affixed to the bag portion 2, thereby helping the user to carry the main body 1.

The pulling portion 3 is provided on the other side of the bag portion 2 opposite to the strap 22. The pulling portion 3 includes a handle 31, two pulling levers 32 and two wheels 33. The handle 31 includes two parallel branch levers 311. A rectangular force-applying lever 312 is horizontally provided at one ends of the two branch levers 311. The other ends of the two branch levers 311 are provided with a pivotal connecting end 313, respectively. The pivotal connecting end 313 is assembled on the bag portion 2. The two pulling levers 32 are pivotally connected to the branch levers 311 through the pivotal connecting end 313, respectively, so as to pivot with respect to the pivotal connecting ends 313. Additionally, the wheels 33 are detachably provided on the pulling levers 32 at one ends distant from the pivotal connecting end 313. As a result, when a user applies a force at the force-applying lever 312, the wheels 33 can be used as pivot points for rolling.

While the branch levers 311 perform an inclined angle with respect to the pulling levers 32, the user is allowed to easily pull the bag portion 2 without much effort.

The receiving portion 4 is provided at a bottom end of the bag portion 2 and is approximately in a hallow cylindrical shape. One end of the receiving portion 4 is provided with a stopping portion 41 and an engaging element 42 at an axial point between an outer rim and an inner rim. Therefore, when the wheels 33 detached from the pulling levers 32 are placed in die receiving portion 4, the diameter of the wheels 33 can be stopped at an inner side of the stopping portion 41. One end of the engaging element 42 is in a hook shape so as to hook at the side of the wheels 33, thereby stably affixing the wheels 33 within the receiving portion 4.

Figure 2:
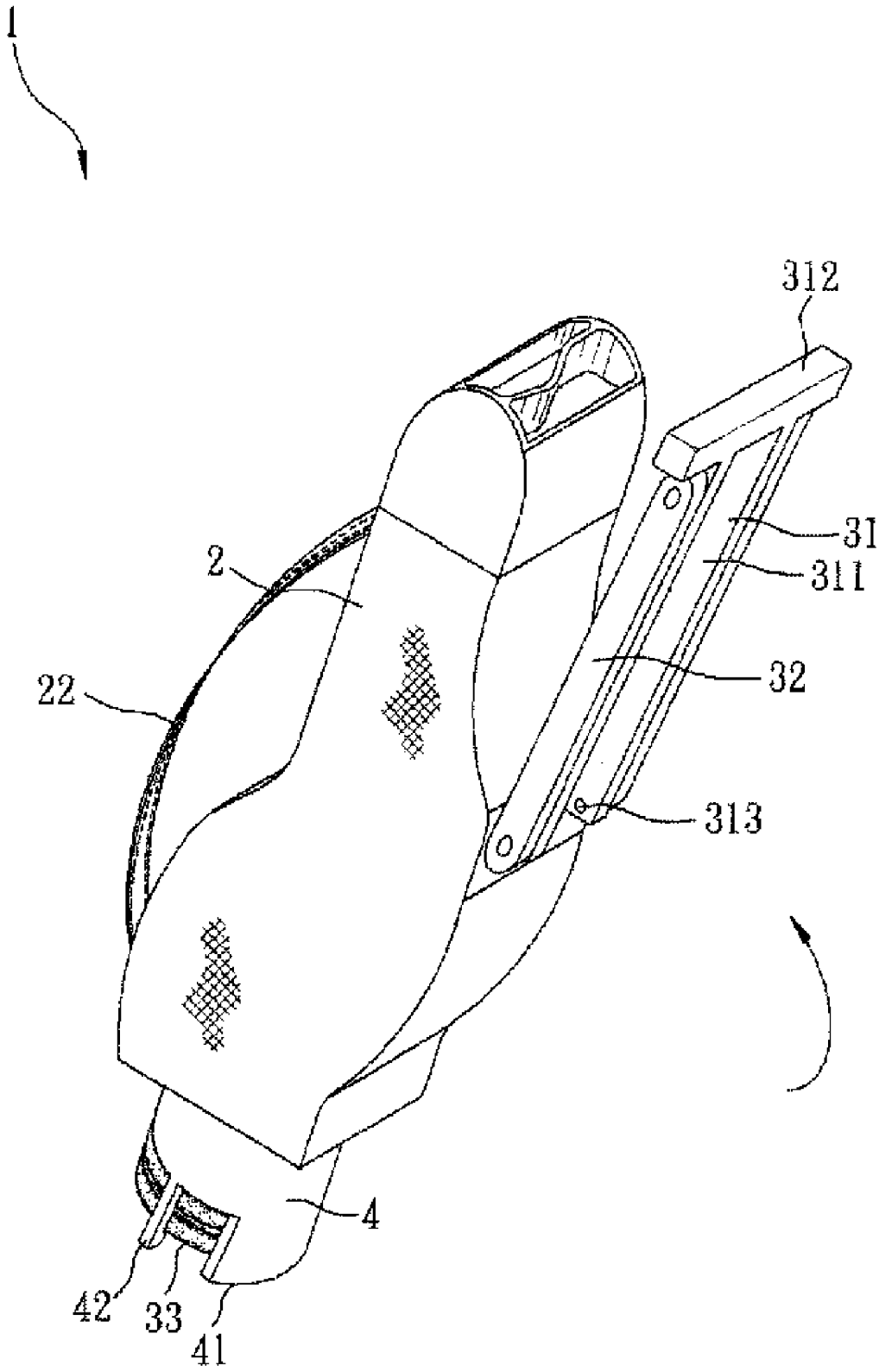
FIG. 2 is a schematic view of the golf bag structure in a retracted form in accordance with the present invention.

Refer to FIG. 2. When the main body 1 is to be retracted, the wheels 33 can be detached from one end of the pulling levers 32. Then, they are placed in the receiving portion 4 at the bottom of the bag portion 2. The stopping portion 41 and the engaging element 42 can stably receive the wheels 33; additionally, the pulling levers 32 can be drawn close to the handle 31. The inner sides of the two pulling levers 32 are connected to the outer sides of the branch levers 311 so as to ensure the branch levers 311 and the pulling levers 32 are retracted as a whole to save space.

Refer to FIG. 3 to FIG. 7, which illustrate other embodiments of the golf bag structure in accordance with the present invention. Therein, the main elements that are the same as those in the first embodiment will not be described in details. The different structure is described below.

Figure 3:
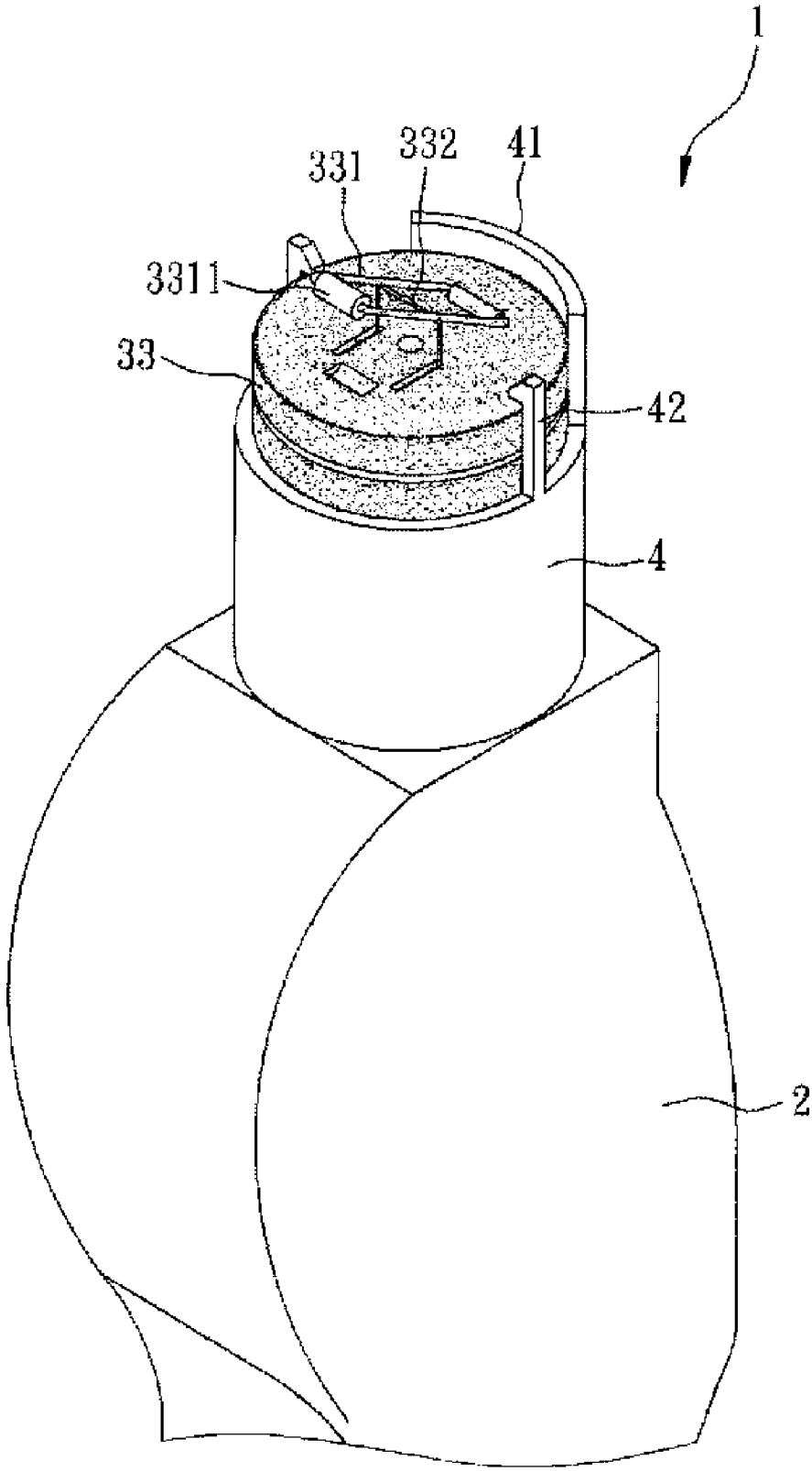
FIG. 3 is a schematic view of the second embodiment of the golf bag structure in accordance with the present invention.

Refer to FIG. 3. In the second embodiment, the side of one of the wheels 33 has a rolling set 331 and a supporting element 332. One end of the rolling set 331 is pivotally connected to the wheel 33, while the other end thereof is provided with a rolling wheel 3311 having a diameter smaller than that of the wheel 33. When the end of the rolling set 331 with the rolling wheel 3311 is lifted due to a force applied, the supporting element 332 can stop the rolling set 331 at the middle portion thereof As a result, when the wheels 33 are received in the receiving portion 4, the user can still pull the handle 31 and allow the rolling wheel 3311 to roll the main body 1. Since the diameter of the rolling wheel 3311 is smaller than that of the wheel 33, the main body 1 can be easily pulled on the ground without the use of the wheels 33.

Figure 4:
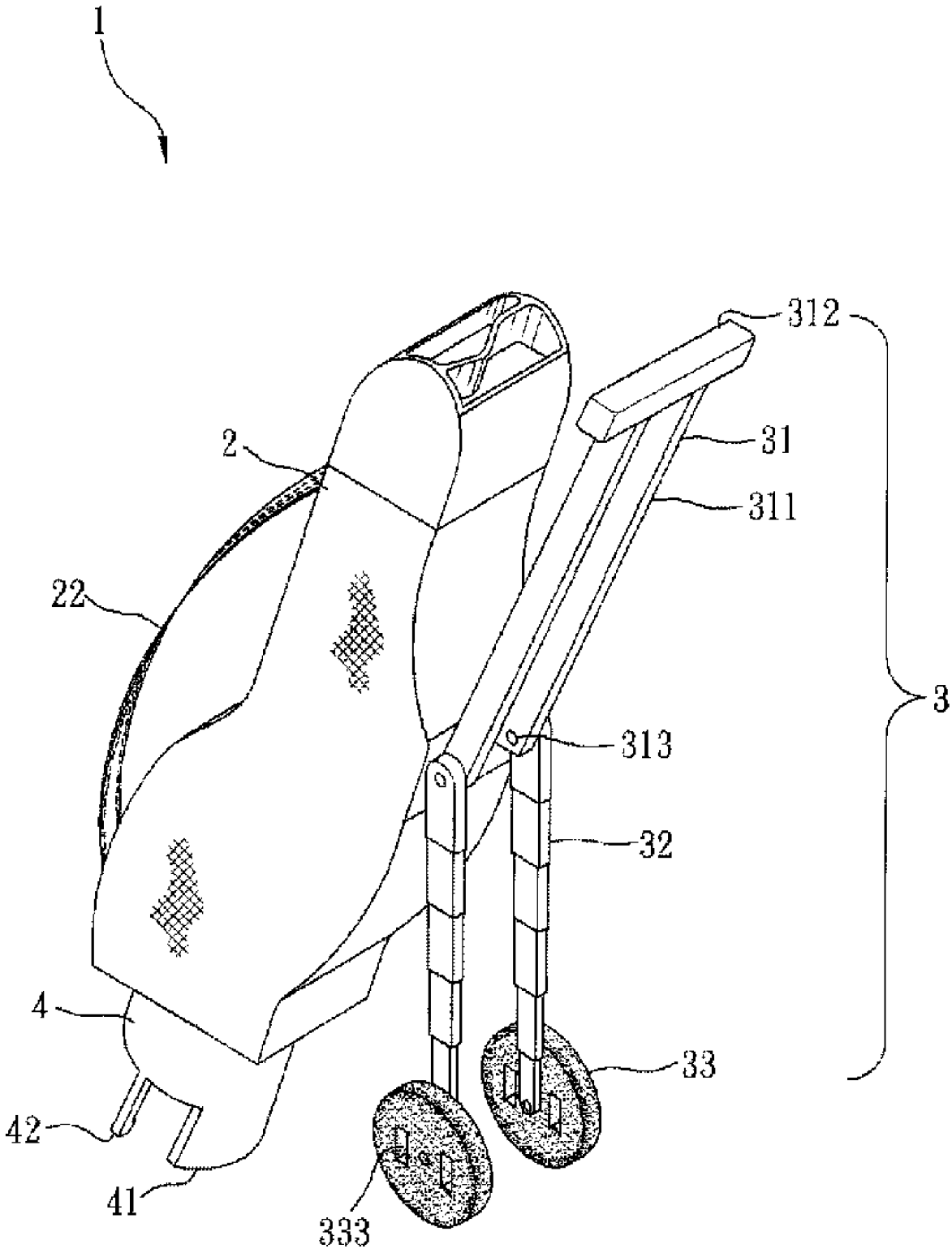
FIG. 4 is a schematic view of the third embodiment of the golf bag structure in accordance with the present invention.
Figure 6:
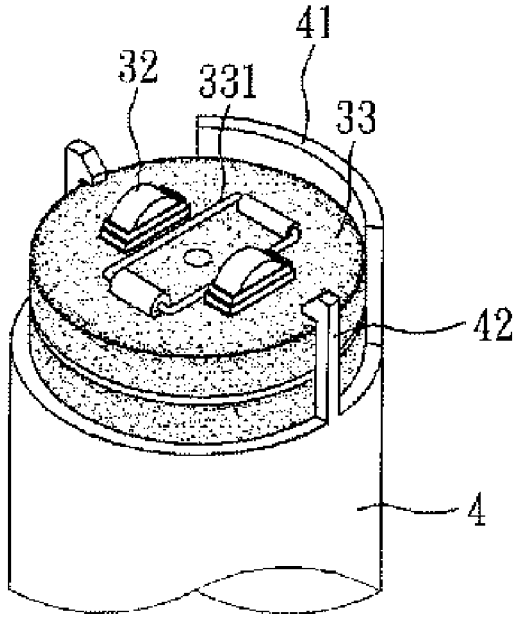
FIGS. 5, 6 are schematic views illustrating retracting procedures of the golf bag structure of the third embodiment in accordance with the present invention.
Figure 5:
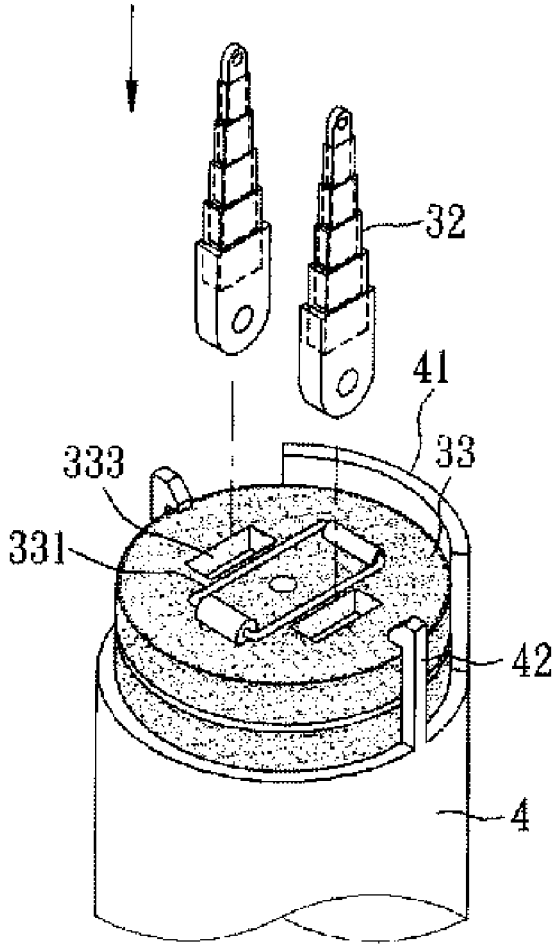

Refer to FIGS. 4 to 6 for the third embodiment. In addition to the rolling set 331l as in the second embodiment two sides of the center of the wheels 33 are provided with a containing portion 333, respectively. The containing portion 333 is in a hole-like shape and is capable of containing the pulling levers 32 therein. The pulling levers 32 can be detached from the pivotal connecting end 313 and in a joint shape for extending purpose. As a result, when the wheels 33 are received in the receiving portion 4, the pulling levers 32 can be shortened. The two pulling levers 32 can be placed in the containing portions 333 within the wheels 33 so as to reduce the size of the main body 1.

Figure 7:
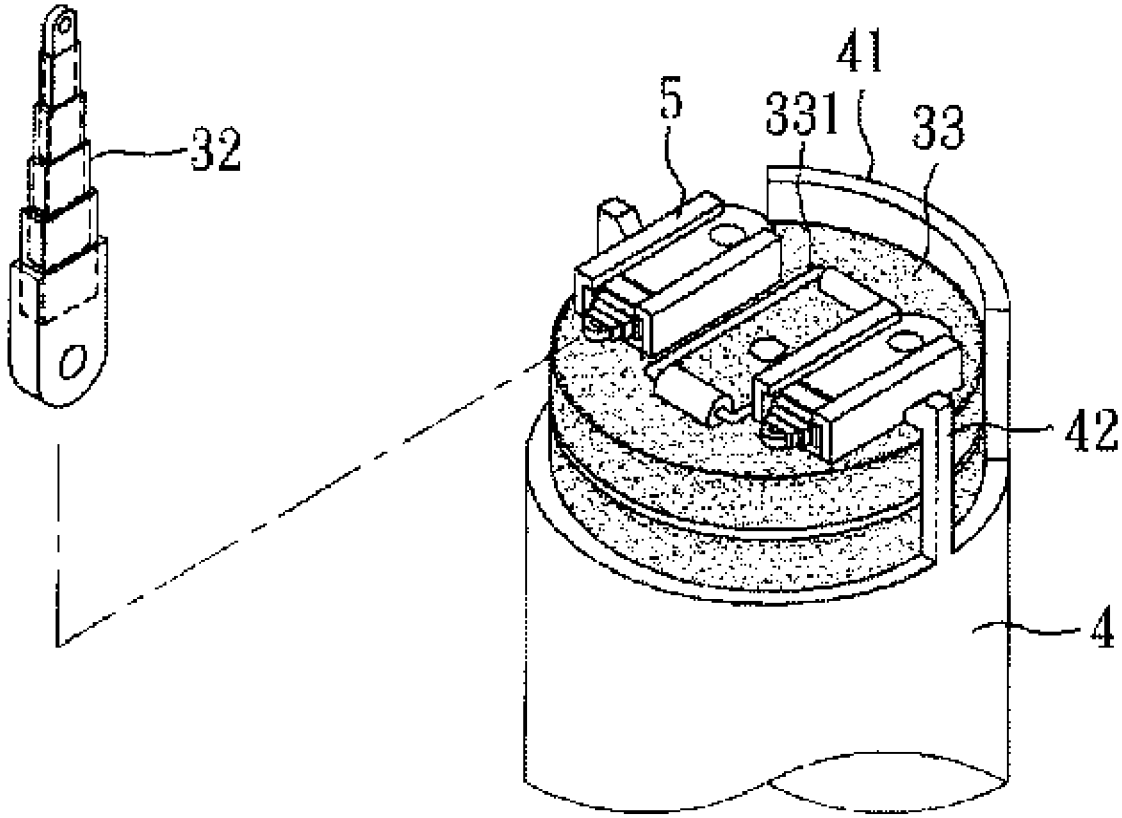
FIG. 7 is a schematic view of the fourth embodiment of the golf bag structure in accordance with the present invention.

Refer to FIG. 7. In the fourth embodiment, the containing portion 333 can be implemented with a fixing piece 5 symmetrically provided at the two sides of the rolling set 331. The fixing pieces 5 are in an L shape such that the shortened pulling levers 32 can be received within the two fixing pieces 5, thereby receiving the pulling levers 32.

Based on the use of the main body 1, the bottom of the bag portion 2 is provided with a receiving portion 4 so as to contain the wheels 33 detached from the pulling levers 32. The pulling levers 32 can be drawn close to the handle 31 so as to save space. Alternatively; the pulling levers 32 are in a joint shape for extending purpose so as to be placed within the containing portion 333 on the sides of the wheels 33 and received within the receiving portion 4. As a result, the size of the main body 1 is reduced when being retracted. Additionally, the sides of the wheels 33 are provided with the rolling set 331. A rolling wheel 3311 with a diameter smaller than that of the wheels 33 is provided on the rolling set 331. Therefore, when the wheels 33 are received in the receiving portion 4, the rolling set 331 can roll the main body 1. Thus, the user can use the wheels 33 based on the various terrains on the golf course as needed. The rolling set 331 can be used on the flat ground. As a result, the user can change the use of the main body 1 based on the environment he/she is in. Thus, the present invention is user-friendly and multifunctional and worth to be promoted to the market.

Although the present invention has been described with the preferred embodiment, the preferred embodiment is not meant to limit the present invention to any form and shape. Those skilled in the art should know that any modification or changes thereof is within the scope and spirit of the present invention.

What is claimed is:

1. A golf bag structure comprising a main body with a bag portion, a pulling portion and a receiving portion, wherein said pulling portion is provided at a side of said bag portion; said pulling portion including a handle, at least one pulling lever and a wheel; said handle assembled with said pulling lever; and said wheel detachably provided at one end of said pulling lever; and said receiving portion provided at one end of said bag portion and for receiving the wheel detached from the pulling lever so as to save space for said main body; one side of said wheel having a rolling set, such that when said wheel is received in the receiving portion, said rolling set can roll said main body.

2. The golf bag structure of claim 1, wherein said receiving portion has at least one engaging element for assisting in affixing said wheel to said receiving portion.

3. The golf bag structure of claim 1, wherein said handle and said pulling lever are pivotally connected so as that said handle and said pulling lever can be drawn close for receiving purpose.

* * * * *